US008631519B1

(12) United States Patent
Belliard et al.

(10) Patent No.: US 8,631,519 B1
(45) Date of Patent: Jan. 21, 2014

(54) TOILET CLEANSER AND DEODORIZER DISPENSER

(76) Inventors: Juan Belliard, Lawrence, MA (US); Porfirio Rodriquez, Lawrence, MA (US)

( * ) Notice: Subject to any disclaimer, the term of this patent is extended or adjusted under 35 U.S.C. 154(b) by 147 days.

(21) Appl. No.: 13/227,110

(22) Filed: Sep. 7, 2011

Related U.S. Application Data

(60) Provisional application No. 61/387,386, filed on Sep. 28, 2010.

(51) Int. Cl.
*E03D 9/00* (2006.01)

(52) U.S. Cl.
USPC ..... 4/225.1; 222/386.5

(58) Field of Classification Search
USPC ..... 4/222, 226.1, 225.1, 227.5, 227.1; 222/327, 386.5, 319, 405
See application file for complete search history.

(56) References Cited

U.S. PATENT DOCUMENTS

| | | | | | |
|---|---|---|---|---|---|
| 2,045,473 | A * | 6/1936 | Dempster Keillor | 4/225.1 |
| 2,424,174 | A * | 7/1947 | Jensen et al. | 4/225.1 |
| 3,061,842 | A * | 11/1962 | Woodruff | 4/225.1 |
| 3,836,335 | A * | 9/1974 | Eppes | 422/50 |
| 3,991,507 | A * | 11/1976 | Bart | 43/54.1 |
| 4,254,894 | A * | 3/1981 | Fetters | 222/1 |
| 4,429,423 | A * | 2/1984 | Syrenne | 4/225.1 |
| 5,042,095 | A * | 8/1991 | Schoepe et al. | 4/225.1 |
| 5,301,838 | A * | 4/1994 | Schmidt et al. | 222/95 |
| 5,332,121 | A * | 7/1994 | Schmidt et al. | 222/95 |
| 6,662,379 | B2 * | 12/2003 | Nguyen et al. | 4/225.1 |
| 6,944,890 | B1 * | 9/2005 | Sim | 4/225.1 |
| 6,978,494 | B2 * | 12/2005 | Wu | 4/507 |

* cited by examiner

*Primary Examiner* — Huyen Le
*Assistant Examiner* — Erin Deery
(74) *Attorney, Agent, or Firm* — Joseph E Funk

(57) ABSTRACT

A toilet cleanser and deodorizer dispenser adapted for placement inside a toilet tank that includes a hanger for hanging the dispenser from the top of the sidewall of the tank, a dispenser housing into which a liquid cleanser and/or deodorizer obtained from any source is inserted into a collapsible bag, and means for controlling the rate at which cleanser and/or deodorizer is dispensed from the dispenser into a toilet bowl as water entering the dispenser forces cleanser and/or deodorizer out of the dispenser.

15 Claims, 3 Drawing Sheets

TOILET CLEANSER AND DEODORIZER DISPENSER

RELATED APPLICATION

This utility patent application claims benefit under U.S. Provisional Patent Application No. 61/387,386, entitled "Toilet Cleaning Dispenser System", filed on Sep. 28, 2010.

FIELD OF THE INVENTION

The invention relates to cleaning and deodorizer material dispensers for toilet tanks and toilet bowls.

BACKGROUND OF THE INVENTION

Toilet cleaning and deodorizing dispensers typically include a water soluble material formed into a tablet or into a cartridge. The tablet is usually hung from the side wall of the toilet bowl or tank. When placed in the toilet bowl, the cleaning and deodorizing tablet is attached to the top side wall of the toilet bowl by a supporting means, such as wires. When the toilet is flushed and the tank is refilling with water, some water passes over the bowl side wall mounted tablet and dissolves some of the cleaning and deodorizing material into the toilet bowl. Since the cleaning and deodorizing tablet must be capable of dissolving quickly due to the short time in which water passes over the tablet as the tank refills with water, such tablets get used quickly. This requires the frequent replacement of the tablet. Since the tablet is located in the toilet bowl, manually replacement can be messy and undesirable.

In addition, cleaning and deodorizing agents in the cleanser tablets for the dispenser may, for example, contain chemicals which are harmful upon direct contact with human skin and eyes. Replacement cleanser tablets which are commonly sold separately require the user to make direct contact with the tablets when they are removed from their packaging to be mounted inside a toilet bowl, and with old tablets inside a toilet bowl that are mostly dissolved and are being replaced. In addition, such cleanser tablets are often brightly colored, typically blue or green, and may tempt younger children to touch or even ingest the cleaning agent, especially since they are mounted inside a toilet bowl where a child can see and touch them. Further, these prior art toilet cleaning and deodorizing dispensers typically require that the user purchase the cleanser/deodorizer tablets from the manufacturer of the dispenser.

Further, prior art toilet cleanser and deodorizer dispensers typically only use cleanser and deodorizer material that are only obtained from the manufacturer of the dispenser. As a result the cost of the cleanser and deodorizer material is usually somewhat costly.

Thus, there is a need in the art for a toilet cleanser and deodorizer dispenser of which the cleaning and/or deodorizing material never needs to be touched during un-packaging, and during installation, replacement or removal, and which is not readily accessible to children. In addition, there is a need in the art for a toilet cleanser and deodorizer dispenser that will readily utilize and function with cleaning and deodorizing materials available from many sources.

SUMMARY OF THE INVENTION

Before installation of the toilet cleanser and deodorizer dispenser, when a toilet is flushed water commences flowing from the fill valve into the toilet tank to refill the tank in the manner known in the art. In addition, some of the water exiting the water fill valve is routed to flow via a first tube into the toilet tank overflow tube and there through into the toilet bowl. With the novel toilet cleanser and deodorizer dispenser the tube from the water fill valve is removed from the overflow tube and is connected to an input to the dispenser. A second or output tube connected to the output of the dispenser is inserted into the overflow tube. As water from the fill valve is filling the toilet tank water pressure in the first tube causes liquid cleanser and/or deodorizer inside the dispenser to exit the dispenser via the second tube and flow into the overflow tube and thence into the toilet bowl. The cleaning and/or deodorizing material cleans and deodorizes the toilet bowl in a manner well known in the art.

Thus, the novel toilet cleanser and deodorizer dispenser is quickly and easily mounted inside of a toilet tank without tools and is suspended from a top of a side wall on the inside of the toilet tank. More specifically, the toilet cleanser and deodorizer dispenser comprises a container that is suspended from the top of the side wall inside the toilet tank. The container has a screw on cap that is temporarily removed to insert liquid cleanser and/or deodorizer material into the container without a person coming into contact with the material. The cleanser and/or deodorizer material in the container is dispensed from a collapsible bag inside the container and via the overflow tube into the toilet bowl as the toilet tank is filled by the water fill valve after the toilet had been flushed.

In an alternative embodiment of the invention there are two bags inside the container, one having a cleaning material therein and the other having another material, such as a deodorizer, therein and both are dispensed from the container as determined by the user when the toilet is flushed. Both materials are dispensed in the same manner.

DESCRIPTION OF THE DRAWINGS

The invention will be better understood upon reading the following Detailed Description in conjunction with drawing in which.

DETAILED DESCRIPTION

Figure 1:
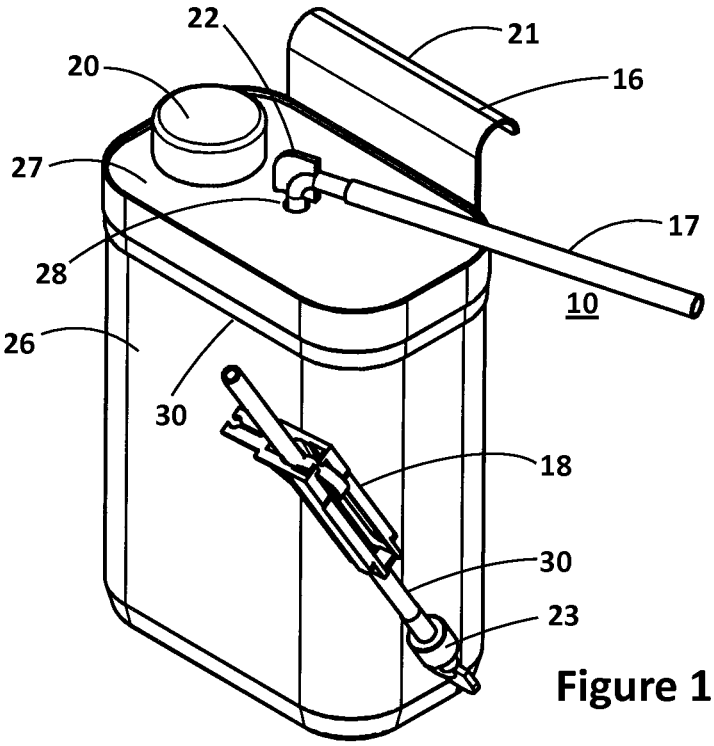
FIG. 1 shows a frontal perspective view of an assembled toilet cleanser and deodorizer dispenser before it is mounted inside a toilet tank.
Figure 3:
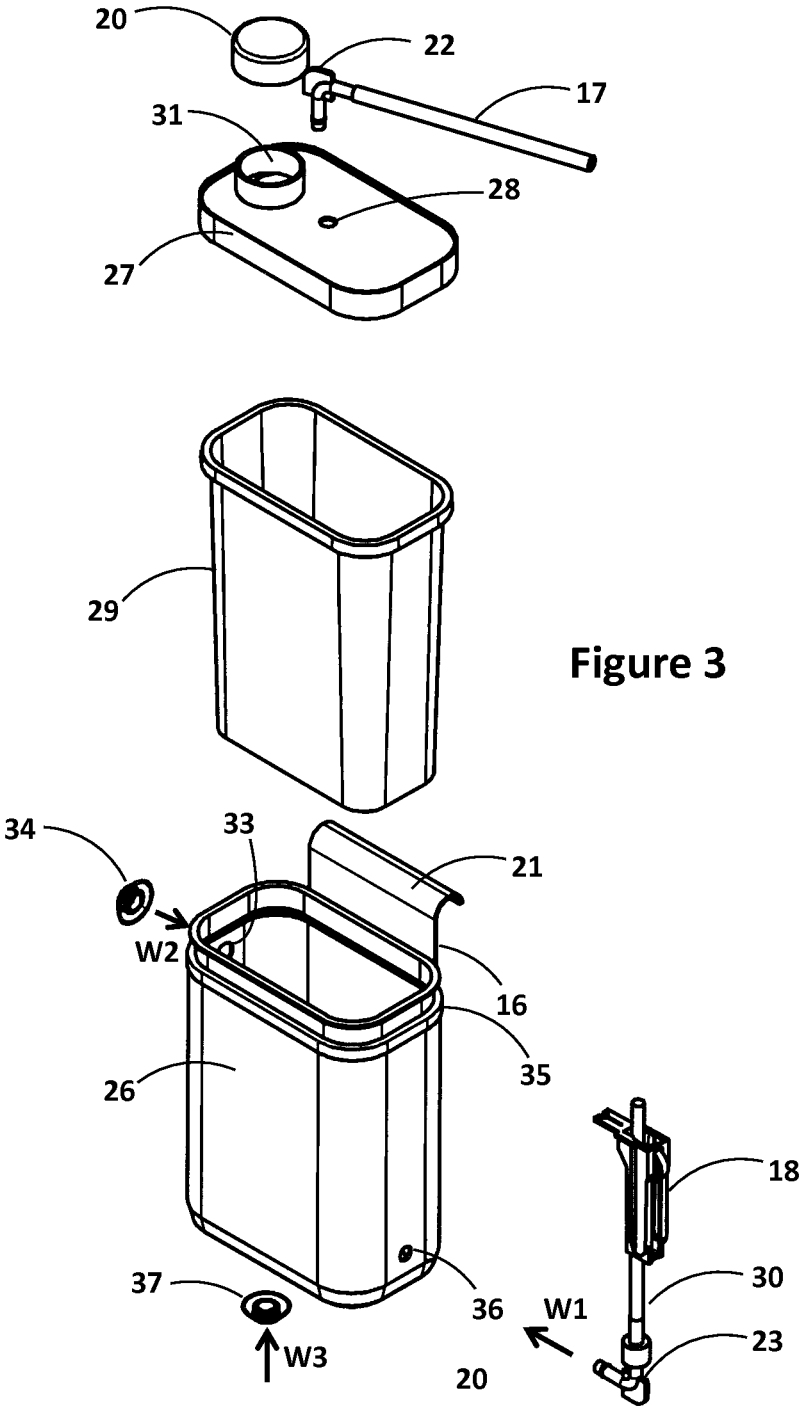
FIG. 3 is an exploded perspective view of the novel toilet cleaning dispenser showing its various components.
Figure 4:
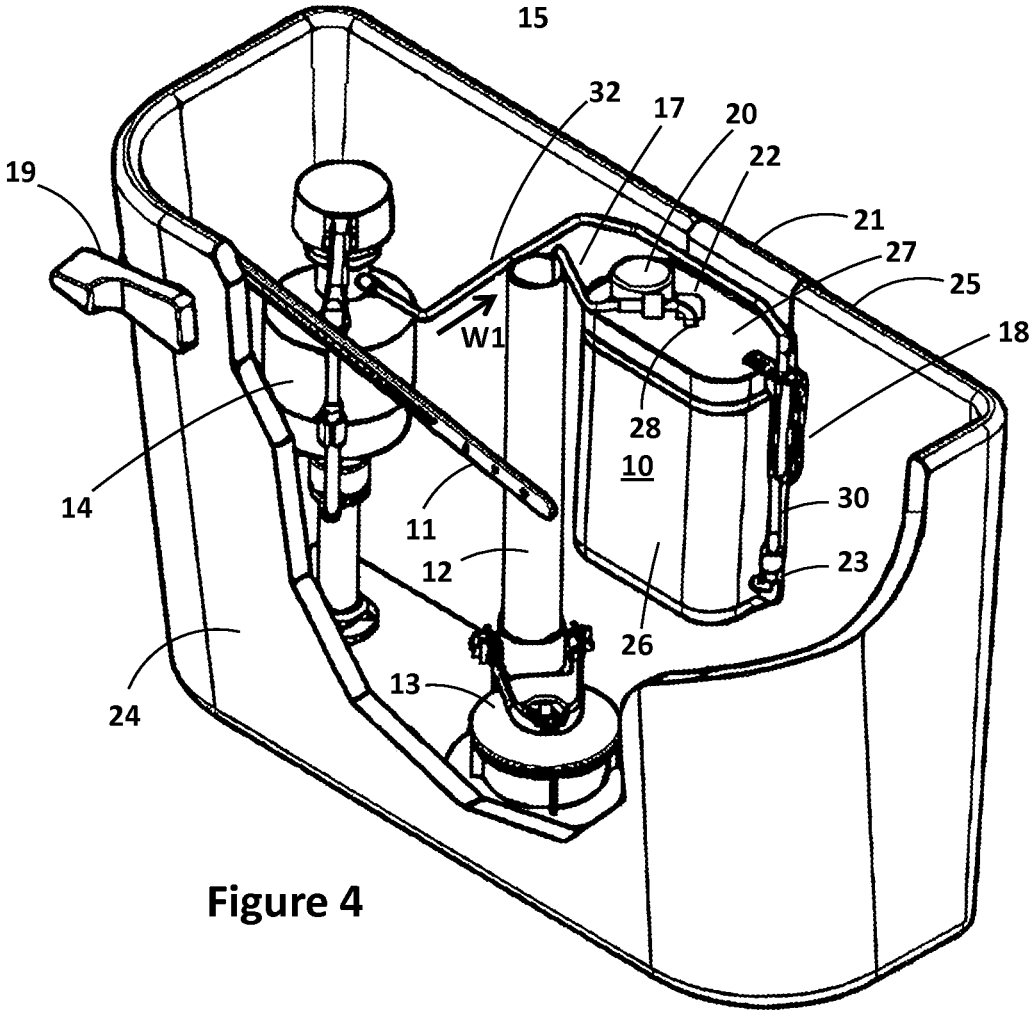
FIG. 4 is a perspective view of a toilet tank with the novel toilet cleaning dispenser system mounted therein.

FIG. 1 shows a frontal perspective view of the assembled toilet cleanser and deodorizer dispenser 10 before it is mounted inside a toilet tank 24 (FIG. 3). Dispenser 10 comprises a container bottom 26 with a sealing snap on top 27. Attached to the rear of container bottom 26 is a back plate 16 with a hanger 21 having an inverted "J" shaped top that is used to hang dispenser 10 on the inside of a toilet tank 24 suspended from the top edge of the tank 24 as shown in FIG. 4. Top 27 has a filler hole 31 (FIG. 3) that has cap 20 screwed thereon to seal hole 31. Liquid cleanser and/or deodorizer material (not shown) are inserted into a flexible, watertight bag 29 (see FIG. 3) that is mounted inside dispenser container 26 via filler hole 31 after screw on cap 20 has been temporarily removed.

Top 27 also has a hole 28 there through into which is mounted in a water tight manner a rigid, hollow, "L" shaped, hollow tubing connector 22. Connected to tubing connector 22 is a piece of flexible tubing 17. The end of tubing 17 not connected to connector 22 is inserted into overflow tube 12 in toilet tank 24 as shown in FIG. 4 when dispenser 10 is installed. Hole 28, connector 22 and tubing 17 comprise the output from dispenser 10 from which liquid cleanser and/or deodorizer is output into overflow tube 12 and thence into the toilet bowl (not shown) (FIG. 4).

Dispenser container 26 has a hole 36 through its side (FIG. 3), near its bottom, into which is mounted in a water tight manner a rigid, hollow, "L" shaped, hollow tubing connector 23. There is a piece of flexible tubing 30 connected to connector 23. The end of flexible tubing 30 not connected to connector 23 is connected to the conventional water outlet of fill valve 14 inside toilet tank 24 as shown in FIG. 4. Connector 23 and flexible tubing 30 comprise the input to dispenser 10 to apply water pressure inside dispenser 10 that causes liquid cleanser and/or deodorizer materials inside a bag 29 (FIG. 3) inside container 26 to be dispensed via output connector 22 and tubing 17 into water overflow tube 12 only while toilet tank 24 is being refilled following flushing.

Flexible tubing 30 at the water input has a control device 18 mounted thereon, as seen in all Figures, that controls the water pressure that is applied to the interior of dispenser 10 beneath bag 29 (FIG. 3), and thereby controls a small amount of water that can flow through flexible tubing 30 into but not out of dispenser 10 each time the toilet is flushed. Control device 18 is well known and is extensively used in hospitals to control the flow of medication supplied intravenously using an IV needle.

Figure 2:
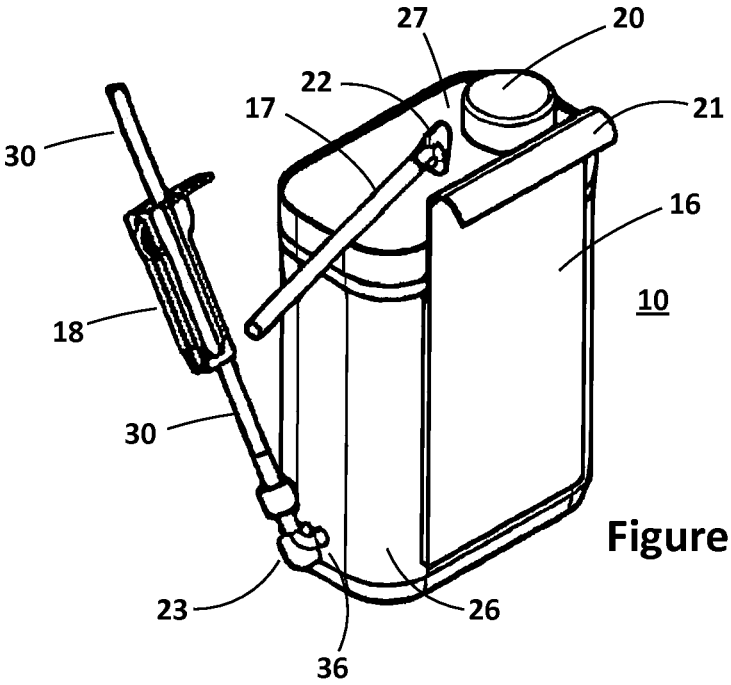
FIG. 2 shows a rearward perspective view of an assembled toilet cleanser and deodorizer dispenser before it is mounted inside a toilet tank.

FIG. 2 is a rearward perspective view of the assembled toilet cleanser and deodorizer dispenser 10 before it is mounted inside a toilet tank. The elements shown in FIG. 2 are shown in and have already been described with reference to FIG. 1 so the description is not repeated here. Better shown in FIG. 2 is back plate 16 with a hanger 21 having an inverted "J" shaped top that is used to hang dispenser 10 on the inside of a toilet tank 24 suspended from the top edge of the tank 24 as seen in FIG. 4. Back plate 16 may be permanently attached to dispenser 10 or it may be detachably attached thereto for ease of removing dispenser 10.

FIG. 3 is an exploded perspective view of the novel toilet cleaning dispenser system showing its various components. There is container 26 that has a hole 36 through its side, near its bottom, into which is mounted in a water tight manner a rigid, a hollow, "L" shaped, hollow tubing connector 23 as also shown in FIGS. 1 & 2. There is a piece of flexible tubing 30 connected to connector 23 as shown. The end of flexible tubing 30 not connected to connector 23 is input to the top of the conventional water outlet of fill valve 14 inside toilet tank 24 as shown in FIG. 4. Connector 23 and flexible tubing 30 comprise the water pressure input to dispenser 10 that causes liquid cleanser and/or deodorizer (not shown) within bag 29 inside container 26 of dispenser 10 to be dispensed via tubing 17 into overflow tube 12 (FIG. 4) only while toilet tank 24 is being refilled following flushing.

There is a hole (not shown) through the bottom of container 26 (not shown in FIG. 3) that is sealed by a flexible sealing plug 37 when it is pushed in the direction of arrow W3 into the bottom hole. When it is desired to drain any water inside container 26 plug 37 is removed from the bottom hole (not shown) to permit the water to drain out.

There is another hole 33 that is through the top of a side wall of container 26 that is normally sealed by a flexible sealing plug 34 when it is pushed in the direction of arrow W2 into hole 33. When it is desired to refill bag 29 inside dispenser 10 with liquid cleaner and/or deodorizer, plug 34 is momentarily removed to relieve any pressure inside sealed dispenser container 26 on the outer side of bag 29. Other pressure relief mechanisms may also be utilized. Plug 34 is reinserted into hole 33, screw on cap 20 is removed and liquid cleaner and/or deodorizer is inserted into bag 29 via opening 31. When bag 29 is completely full, or is filled to a desired level, cap 20 is screwed back onto opening 31 to reseal dispenser 10. In this process a person never has to come into contact with cleanser and/or deodorizer.

Inserted into container 26 during assembly of dispenser 10 is a flexible, non-porous, water tight bag 29. The top of bag 29 is fitted over the top lip of container 26 and dispenser cover 27 is snapped onto the top of container 26 and locked thereon by a locking lip 35. This creates a watertight seal at the top of bag 29. In this position any water that enters the bottom of container 26 via hole 36 cannot mix with cleanser and/or deodorizer inside bag 29. Bag 29 may be replaced by removing snap on cover 27, removing an old or damaged bag 29, installing a new bag 29 as described above, and snapping cover 27 back onto the top of container 26.

As previously described a liquid cleaner and/or deodorizer (not shown) is inserted directly into flexible, watertight, non-porous bag 29 via cap 20 and threaded hole 31. The cleaner and/or deodorizer material may be from any source and manufacturer.

In an alternative embodiment of the invention a single bag 29 may be replaced by two bags (not shown) that are positioned side by side inside dispenser container 26, and a second hole with screw on cap for refilling is provided in container cover 27. Additionally, a second hole 28 with a second connector 23 and tubing 17 are provided over the second bag. Thus, each bag has its own filler cap, connector hole, connector and tubing. With this configuration the top of container must be modified to provide cross members so that each of the bags has a surface over which to mount their open tops, and the underside of dispenser cover 27 must be modified to provide pressure to seal the entire top edge of each bag so no water entering container 29 can enter the two bags.

FIG. 4 shows a perspective view of a toilet tank 24 with the novel toilet cleanser and deodorizer dispenser 10 mounted therein. As shown in FIG. 4 and as previously described with reference to FIG. 2, the top "J" hook 21 of back plate 16 attached to the rear side of container 26 is hooked over the top edge 25 of toilet tank 24 as shown. This is easily done with no tools being required. Initially, there is a piece of flexible hosing (not shown) having one end connected to a water outlet 15 of fill valve 14 and the other end inserted into the top of overflow tube 12 that is removed. In its place one end of new tubing 32 is connected to water outlet 15 of fill valve 14 and its other end is connected to the top end of tubing 30 which is connected to tubing connector 23 which is mounted in the bottom side wall of container 26 through hole 36. Rather than two pieces a single continuous piece of flexible tubing 30 may be utilized. When the toilet is flushed, and fill valve 14 is refilling toilet tank 24, water pressure and water are applied through tubing 32, in the direction indicated by the arrow W1, and through tubing 30 and "L" shaped connector 23 into the input at the bottom of dispenser container 26. The toilet is flushed in a conventional manner using handle 19 to lift flapper 13. The chain that normally connects handle arm 11 and flapper 13 is well known in the art and is not shown to avoid cluttering the drawing.

The amount of water that can flow through tubing 31 is adjusted using control device 18 is a small amount. This water enters container 26 via opening 36 below any bag 29 or bags mounted inside container 26 of dispenser 10. The amount of water that enters dispenser 10 at hole 36 applies water pressure to the bottom of the outer surface of bag 29 or bags that are mounted inside dispenser container 29. This pressure causes an amount of liquid cleaner and/or deodorizer (not shown) to be expelled from dispenser 10 via tubing 17 that is equal in volume to the water entering the bottom of dispenser 10.

After a dispenser 10 is initially installed into toilet tank 24 as shown in FIG. 4 its cap 20 is removed and liquid cleansing and/or deodorizing material is inserted into container 26 via fill hole 31. When the cleansing and/or deodorizing material is depleted cap 20 is again removed and additional cleansing and/or deodorizing material is inserted into container 26 through the fill hole 31 (not shown in FIG. 4 but shown in FIG. 3) through top 27 of dispenser 10. As this is done the person doing the filling does not come into physical contact with the cleansing and/or deodorizing material. As previously described, when refilling bag 29 inside dispenser container 26, plug 34 (or another pressure relief valve) is first momentarily removed to relieve any pressure on the outside of bag 29 that might cause residual cleansing and/or deodorizing material to be ejected from the top of dispenser 10 when cap 20 is removed to refill the dispenser.

The parts of dispenser 10, except for tubing 17 and 30 and flow control device 18, may all be made of plastic, but other materials may be used. Flexible bag 29 may be made of different materials. The cleansing and/or deodorizing materials utilized with toilet cleanser and deodorizer dispenser 10 are liquids that can pass through filler hole 31 through top 27 (FIG. 3).

While what has been described herein is a preferred embodiment of the invention, and some alternatives by being able to change the location of the input and output connectors and their associated tubing, those skilled in the art will recognize that numerous changes may be made without departing from the spirit and scope of the invention.

The invention claimed is:

1. A dispenser for a toilet having a toilet bowl and toilet tank, the dispenser dispensing material inside the dispenser into the toilet bowl immediately after the toilet has been flushed and until the toilet tank is filled, the toilet tank having a water fill valve and an overflow tube, the dispenser comprising:

a container for holding the material; the container having an open top for accessing an interior of the container, the container having a side wall and a bottom wall, there is a first opening through the side wall near the bottom wall of the container;

a flexible, waterproof bag positioned inside the container, the bag for holding the material to be dispensed;

a removable cover for sealing the open top of the container, the cover having a second opening there through which is sealed by a removable cap, and having a third opening through the cover;

an input means to the dispenser, the input means having two ends, a first end connected to the water fill valve and a second end that is inserted into the first opening;

control means cooperating with the input means for adjusting the rate of the flow of water from the fill valve into the bottom of the container beneath the bag via the first opening;

an output means having two ends, a first end inserted into the overflow tube and a second end inserted into the third opening;

wherein when the toilet is flushed and while the toilet tank is being refilled with water from the water fill valve via the overflow tube, an amount of water from the fill valve, as adjusted by the control means, passes through the input means into the bottom of the dispenser container beneath the flexible, waterproof bag via the first opening and compresses the bag to dispense a controlled amount of the material to be dispensed via the output means into the toilet overflow tube and thereby into the toilet bowl.

2. The toilet dispenser of claim 1 wherein the material to be dispensed is placed inside the bag inside the container via the second opening when its removable cap is removed.

3. The toilet dispenser of claim 2 wherein the material placed inside the bag inside the container comprises either or both a cleanser material and a deodorizer material.

4. The toilet dispenser of claim 3 wherein the toilet tank has a top wall and the container further comprises a hanger for suspending the dispenser inside the toilet tank from its top wall.

5. The toilet dispenser of claim 4 wherein there is a fourth opening through the side wall near the top of the container and further comprising a first plug to seal the fourth opening, the first plug being removed momentarily before removing the cap on the second opening to insert the material into the bag inside the container.

6. The toilet dispenser of claim 5 wherein there is a fifth opening through the bottom wall of the container and further comprising a second plug to seal the fifth opening, the second plug being momentarily to drain water inside the container below the bag before inserting the material into the bag inside the container.

7. The toilet dispenser of claim 1 wherein the material placed inside the bag inside the container comprises either or both a cleanser material and a deodorizer material.

8. The toilet dispenser of claim 5 wherein the toilet tank has a top wall and the dispenser container further comprises a hanger for suspending the dispenser inside the toilet tank from its top wall.

9. The toilet dispenser of claim 7 wherein the water input means further comprises control means for adjusting the rate of the flow of water from the fill valve into the bottom of the container beneath the bag.

10. The toilet dispenser of claim 8 wherein there is a fourth opening through the side wall near the top of the container and further comprising a first plug to seal the fourth opening, the first plug being removed momentarily before removing the cap on the second opening to insert the material into the bag inside the container.

11. The toilet dispenser of claim 10 wherein there is a fifth opening through the bottom wall of the container and further comprising a second plug to seal the fifth opening, the second plug being momentarily to drain water inside the container below the bag before inserting the material into the bag inside the container.

12. The toilet dispenser of claim 1 wherein the water input means further comprises control means for adjusting the rate of the flow of water from the fill valve into the bottom of the container beneath the bag.

13. The toilet dispenser of claim 12 wherein there is a fourth opening through the side wall near the top of the container and further comprising a first plug to seal the fourth opening, the first plug being removed momentarily before removing the cap on the second opening to insert the material into the bag inside the container.

14. The toilet dispenser of claim 13 wherein there is a fifth opening through the bottom wall of the container and further comprising a second plug to seal the fifth opening, the second plug being briefly removed to drain water inside the container below the bag before inserting the material into the bag inside the container.

15. The toilet dispenser of claim 1 wherein there is a fourth opening through the side wall near the top of the container and further comprising a first plug to seal the fourth opening, the first plug being removed momentarily before removing the cap on the second opening to insert the material into the bag inside the container.

* * * * *